US011792558B2

(12) United States Patent
Yokota

(10) Patent No.: US 11,792,558 B2
(45) Date of Patent: Oct. 17, 2023

(54) HEADPHONE COVER

(71) Applicant: Shuji Yokota, Tochigi (JP)

(72) Inventor: Shuji Yokota, Tochigi (JP)

( * ) Notice: Subject to any disclaimer, the term of this patent is extended or adjusted under 35 U.S.C. 154(b) by 120 days.

(21) Appl. No.: 17/596,632

(22) PCT Filed: Jun. 23, 2020

(86) PCT No.: PCT/JP2020/024681
§ 371 (c)(1),
(2) Date: Dec. 15, 2021

(87) PCT Pub. No.: WO2020/262411
PCT Pub. Date: Dec. 30, 2020

(65) Prior Publication Data

US 2022/0167073 A1 May 26, 2022

(30) Foreign Application Priority Data

Jun. 24, 2019 (JP) ..... 2019-116744

(51) Int. Cl.
*H04R 25/00* (2006.01)
*H04R 1/10* (2006.01)
*H04R 5/033* (2006.01)

(52) U.S. Cl.
CPC ..... *H04R 1/1008* (2013.01); *H04R 5/0335* (2013.01)

(58) Field of Classification Search
CPC ... H04R 1/1008; H04R 5/0335; H04R 1/1058
USPC ..... 381/374
See application file for complete search history.

(56) References Cited

U.S. PATENT DOCUMENTS

2011/0216909 A1* 9/2011 Sapiejewski ..... H04R 1/1083 381/371
2016/0086458 A1* 3/2016 Biggs ..... A61H 23/0218 340/407.1

FOREIGN PATENT DOCUMENTS

JP H0644290 U 6/1994
JP 2015133609 A 7/2015
WO 2020202535 A1 10/2020

OTHER PUBLICATIONS

Search Report Issued by Foreign Patent Office in Application No. 2019-116744.
Office Action for Japanese Counterpart Application No. 2019-116744 dated Mar. 14, 2023 with English Translation.

* cited by examiner

*Primary Examiner* — Phylesha Dabney
(74) *Attorney, Agent, or Firm* — Rosenberg, Klein & Lee

(57) ABSTRACT

[Problem] To provide a headphone cover that does not block a sound from a headphone and is able to keep its fabric stably covering the headphone.

[Solving Means] A headphone cover 1 includes fabric 14 that has an opening in a position corresponding to the sound passage position on one side of an ear pad and is foldable at least from the one side toward another side of the ear pad by 90° and a core 16 disposed around the opening. The compressive yield force in the extending direction of the core 16 is equal to or greater than 0.0587 Mpa.

4 Claims, 8 Drawing Sheets

HEADPHONE COVER

TECHNICAL FIELD

The present invention relates to a headphone cover used between the ear pad of a closed-back headphone and an ear.

BACKGROUND ART

There have been known headphone covers for covering the ear pad of a headphone. A headphone cover is typically formed of thin fabric so that a sound easily passes therethrough. For this reason, the headphone cover has a problem that the fabric degrades due to friction caused in daily use, in particular, the fabric is easily torn around an opening. To solve such a problem, Patent Literature 1 discloses a headphone cover the portion of which around an opening is formed of flat rubber, which is resistant to friction, and thus is prevented from being torn.

CITATION LIST

Patent Literature

[Patent Literature 1] Japanese Patent Application Publication No. 2018-191345

Non-Patent Literature

[Non-Patent Literature 1] TAKAHASHI Masako, HORIGUCHI Keiko, & TAKAMURA Kazunori, "A Basic Study of Finger Power."

[Non-Patent Literature 2] SUDA Mayuka, "Likelihood of Runs in Stocking Fiber Based on Difference between Knitting Methods and Relationship between Stress and Strain"

SUMMARY OF INVENTION

Problem Solved by Invention

However, the headphone cover of Patent Literature 1 cannot be formed of thick fabric because it is necessary to easily pass a sound through the central portion of the headphone cover. Although this problem is solved by forming a sound passage opening in the central portion of the headphone cover, this solution causes another problem that the headphone cover is easily displaced or detached from the headphone.

An object of the present invention is to provide a headphone cover that does not block a sound from a headphone and is able to keep its fabric stably covering the headphone.

Solution to Problem

A headphone cover of the present invention is a headphone cover used between an ear pad of a closed-back headphone and an ear. The headphone cover includes fabric that has an opening in a position corresponding to a sound passage position on one side of the ear pad and is foldable from the one side toward another side of the ear pad and a core disposed around the opening. A compressive yield force in an extending direction of the core is equal to or greater than 0.0587 Mpa.

According to the present invention, the headphone cover has the opening in the position corresponding to the sound passage position on the one side of the ear pad and thus does not block a sound from the headphone. The core disposed around the opening has a compressive yield stress of 0.0587 Mpa or more in the extending direction. Thus, the core is prevented from being displaced or detached after mounting the headphone cover on the headphone, and the fabric is kept stably covering the ear pad.

In the headphone cover of the present invention, the core is deformed when bending stress in a direction perpendicular to the extending direction is equal to or smaller than 0.057 Mpa.

According to the present invention, a user is allowed to easily deform the core of the headphone cover with fingers and to easily mount the core on an inner portion of the ear pad of the headphone.

The headphone cover of the present invention includes fixing flat rubber disposed on the other side of the fabric.

According to the present invention, the flat rubber prevents the other side of the fabric from being torn, due to its resistance to friction and keeps the headphone cover stably mounted on the headphone.

Advantageous Effects of the Invention

According to the present invention, the headphone cover has the opening in the position corresponding to the sound passage position on the one side of the ear pad and thus does not block a sound from the headphone. The core disposed around the opening has a compressive yield stress of 0.0587 Mpa or more in the extending direction. Thus, the core is prevented from being displaced or detached after mounting the headphone cover on the headphone, and the fabric is kept stably covering the ear pad.

DESCRIPTION OF EMBODIMENTS

Now, an embodiment of the present invention will be described in detail with reference to the drawings.

Figure 1:
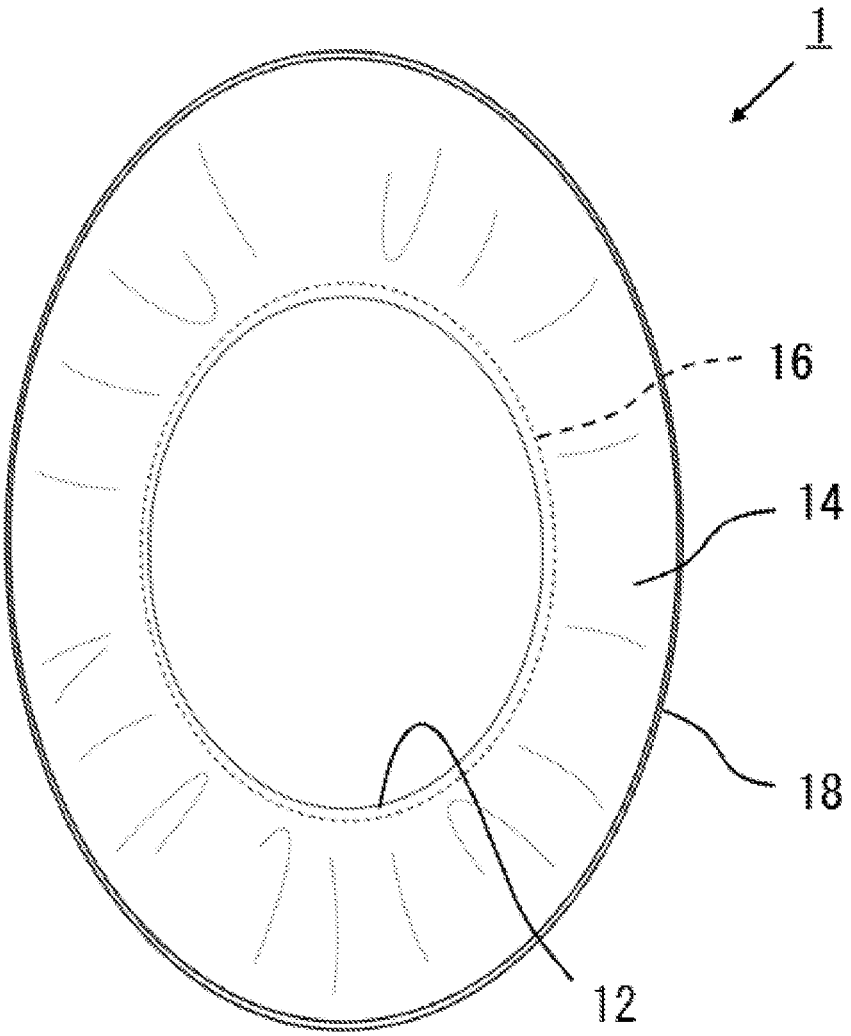
FIG. 1 is a plan view of a headphone cover according to an embodiment of the present invention.
Figure 2:
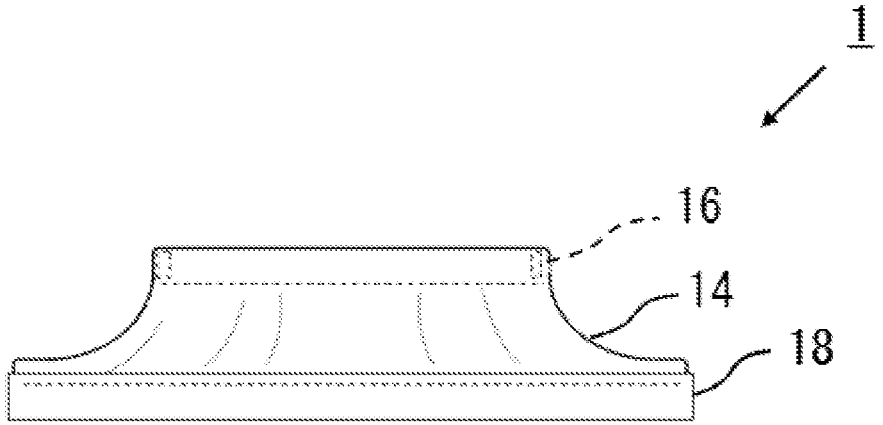
FIG. 2 is a side view of the headphone cover according to the embodiment.
Figure 3:
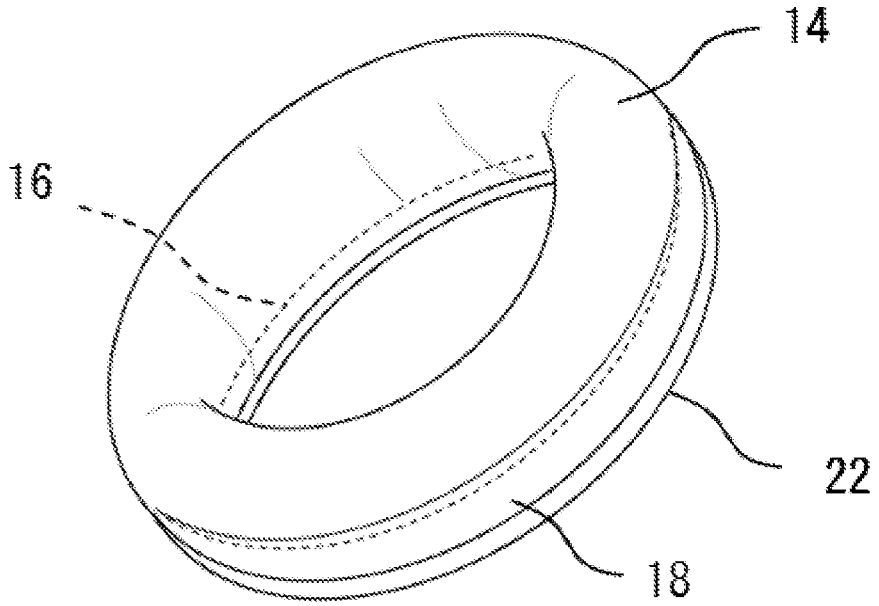
FIG. 3 is a perspective view showing a state in which the headphone cover according to the embodiment is mounted on the ear pad of a headphone.

FIGS. 1 to 3 are drawings showing an example configuration of a headphone cover 1 according to the present embodiment, in which FIG. 1 is a plan view of the headphone cover 1; FIG. 2 is a side view; and FIG. 3 is a perspective view showing a state in which the headphone cover 1 is mounted on the ear pad 22 of a headphone. The headphone cover 1 according to the present embodiment is formed of fabric and is not constant in shape, and FIGS. 1 and 2 show an example of the shape of the headphone cover 1.

The headphone cover 1 according to the present embodiment is used between the ear pad 22 of the closed-back headphone (also referred to as the "over-ear headphone") and an ear.

The headphone cover 1 includes fabric 14 that has an oval opening 12 in the central portion thereof, that is, in a position corresponding to the sound passage position on one side of the ear pad 22 of the closed-back headphone (hereafter also simply referred to as the "headphone") having the headphone cover 1 mounted thereon. The fabric 14 is foldable at least from the one side toward another side of the ear pad 22 by 90°. The other side of the fabric 14 is provided with flat rubber 18 for fixing the other side to the headphone. In the present embodiment, the flat rubber 18 is sewn on the surface of the other side of the fabric 14 using a thread. Since the flat rubber 18 is resistant to friction and is strong, the headphone cover 1 is stably mounted on the headphone using the flat rubber 18.

A core 16 is disposed around the opening 12 of the fabric 14. By inserting the ear pad 22 of the headphone into the headphone cover 1 from the side on which the flat rubber 18 is disposed and fixedly disposing the core 16 inside the ear pad 22, the headphone cover 1 is mounted on the headphone such that the ear pad 22 is covered by the fabric 14. While, in the present embodiment, the core 16 is mounted on the fabric 14 such that the core 16 is covered by the fabric 14 folded around the opening 12, it need not be mounted on the fabric 14 as described above and may be mounted on a portion around the opening 12 of the fabric 14 so as to be visually recognized from the outside.

The reason why the core 16 is disposed on the portion around the opening 12 of the fabric 14 is that when covering the ear pad 22 of the closed-back headphone with the fabric 14, the core 16 serving as a bone is fixedly disposed as a point of support inside the ear pad 22 and thus the fabric 14 is kept stably covering the ear pad 22.

The core 16 has both softness that allows the core 16 to be deformed as necessary when mounting the headphone cover 1 and stiffness that keeps the headphone cover 1 stably with the fabric 14 covering the ear pad 22 after mounting the headphone cover 1.

With respect to the softness, the core 16 is deformed when bending stress in a direction perpendicular to the extending direction is equal to or smaller than 0.057 Mpa. Thus, a user is allowed to easily deform the core 16 by picking the perimeter of the core 16 of the headphone cover 1 with fingers and to easily mount the core 16 on an inner portion of the ear pad 22 of the headphone.

Figure 4:
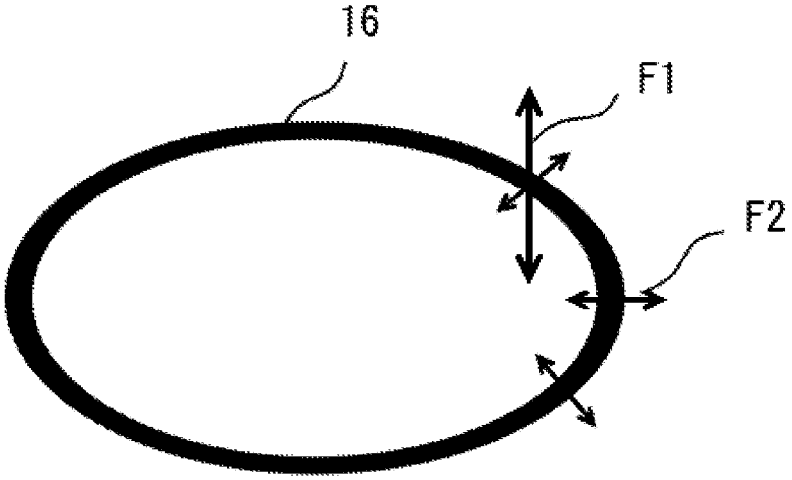
FIG. 4 is a drawing showing forces applied to a core when mounting the headphone cover.

The ground for the value of the bending stress of the core 16 will be described with reference to FIG. 4. As shown in FIG. 4, when mounting the headphone cover 1, a force (bending stress) F1 in the longitudinal expansion/contraction direction and a force (bending stress) F2 in the lateral expansion/contraction direction are applied to the core 16 serving as the central portion of the headphone cover 1.

The user mounts the core 16 on the ear pad 22 by deforming the core 16 and moving it around the periphery of the ear pad 22. For this reason, the core 16 preferably has deformation characteristics that allow the user to bend the core 16 by a small force regardless of sex, age, or the like.

According to Non-Patent Literature 1, the minimum measured value of the grip strength of the fingers is 5.7 N=0.057 Mpa. For this reason, the core 16 is bent by this force in the present embodiment.

With respect to the stiffness, the compressive yield stress in the extending direction of the core 16 is equal to or greater than 0.0587 Mpa. This stiffness prevents the core from being displaced or detached after mounting the headphone cover 1 on the headphone and keeps the headphone cover 1 stably covering the ear pad 22.

The ground for the value of the above compressive yield stress will be described with reference to FIGS. 5 and 6. First, a force applied in the longitudinal direction (in the up-down direction toward the paper surface in FIG. 6) to the core 16 after mounting the headphone cover 1 on the headphone will be described.

Figure 5:
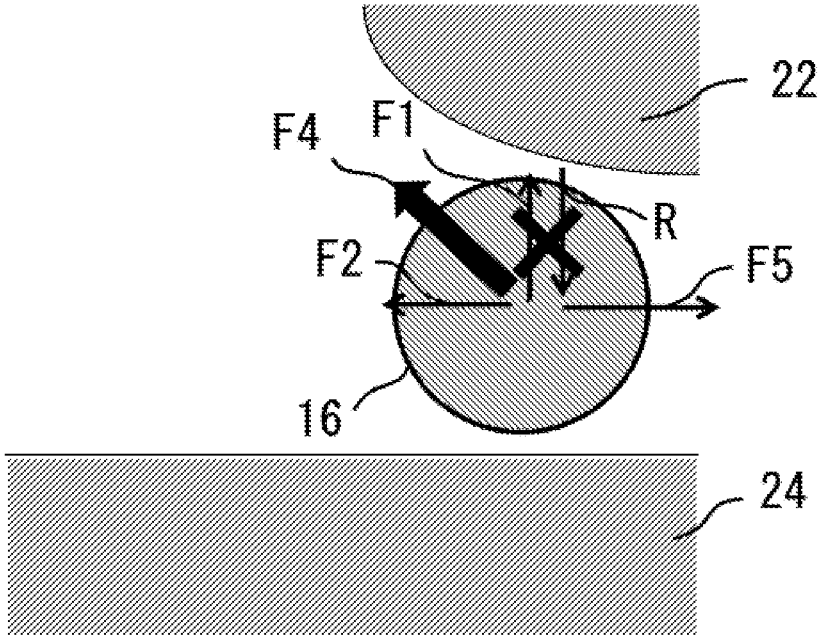
FIG. 5 is a drawing showing forces applied to the core after mounting the headphone cover on the headphone.

As shown in FIG. 5, a fabric tensile force F4 is applied to the core 16 after mounting the headphone cover 1 on the headphone. This force is divided into a force F1 in the vertical direction (in the up-down direction of FIG. 5) and a force F2 in the horizontal direction (in the left-right direction of FIG. 5).

By disposing the core 16 in the gap between the ear pad 22 and a headphone body 24, the vertical force F1 is canceled out by a reaction force R from the ear pad 22. For this reason, the core 16 of the headphone cover 1 only has to be disposed in the gap between the ear pad 22 and headphone body 24. Specifically, the core 16 of the headphone cover 1 preferably has a circumference greater than the inner circumference of the ear pad 22 and smaller than the outer circumference thereof and is disposed in the gap between the ear pad 22 and headphone body 24 regardless of the shape (ring shape, rectangular shape, deformed shape, etc.) of the ear pad 22 of the closed-back headphone.

Figure 6:
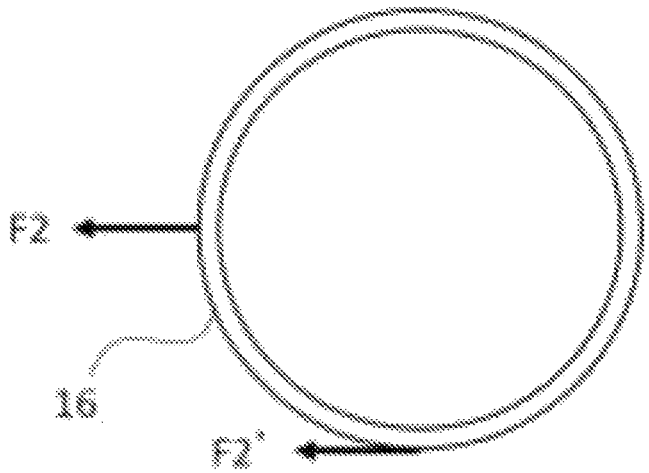
FIG. 6 is a drawing showing forces applied to the core after mounting the headphone cover on the headphone.

While the horizontal force F2 acts as bending stress at the point of effort, it acts as a compression force F2' at another position (a position extending in the same direction as F2) of the core 16, as shown in FIG. 6. When the core 16 is compressed by F2', the core 16 may depart from the ear pad 22.

As will be described later, F2'=F2≈0.0587 Mpa. For this reason, the compressive yield stress in the extending direction of the core 16 is set to 0.0587 Mpa or greater.

The core 16 only has to have the above softness and stiffness by the shape and material thereof. Examples of the material of the core 16 include a wide variety of materials, including rubber-based, plastic-based, wood-based, metal-based, and ore-based materials.

The fabric 14 may or may not have expansion/contraction properties. It may absorb an external force by expanding and contracting, or may be present in a fixed position without expanding or contracting.

According to Non-Patent Literature 2, the stress of a 110 denier fabric with a strain of 1% is about 0.083 Mpa. For this reason, it is assumed that the fabric tensile force F4 is 0.083 Mpa. When the fabric tensile force F4 occurs at an upward angle of 45° with respect to the core 16, as shown in FIG. 5, the magnitude of the force F2 divided in the horizontal direction becomes 0.083 Mpa/√2=0.0587 Mpa≈0.06 Mpa. When the fabric 14 has a modulus of longitudinal elasticity equal to or greater than 0.06 Mpa in all directions, it is present in a fixed position without expanding or contracting.

When the fabric 14 has a modulus of longitudinal elasticity smaller than 0.06 Mpa, it absorbs an external force by expanding or contracting.

As described above, the headphone cover 1 has the opening 12 in the position corresponding to the sound passage position on the one side of the ear pad 22. Thus, the headphone cover 1 does not block a sound from the headphone. The core 16 disposed around the opening 12 has a compressive yield stress of 0.0587 Mpa or more in the extending direction. This prevents the core 16 from being displaced or detached after mounting the headphone cover 1 on the headphone and keeps the headphone cover 1 stably covering the ear pad 22. The core 16 is deformed when bending stress in a direction perpendicular to the extending direction is equal to or smaller than 0.057 Mpa. Thus, a user is allowed to easily deform the core 16 by picking the core 16 of the headphone cover 1 with fingers and to easily mount the core 16 on the inner portion of the ear pad 22.

Figure 7A:
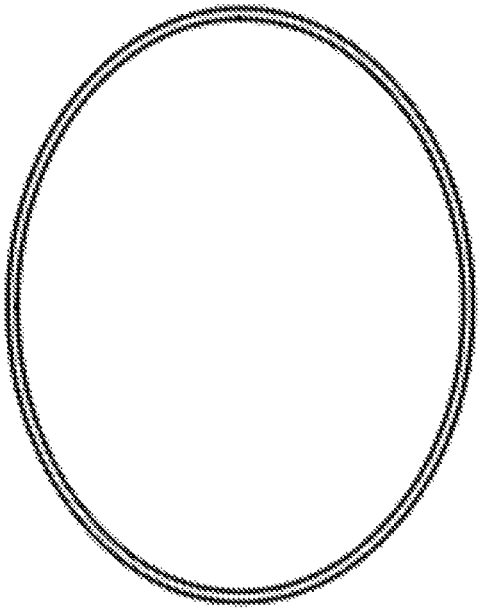
FIGS. 7(*a*), 7(*b*), and 7(*c*) are drawings showing modifications of the shape of the core of the headphone cover.
Figure 7B:
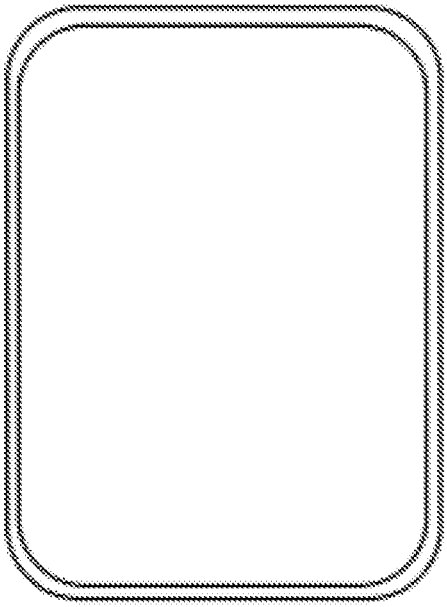
Figure 7C:
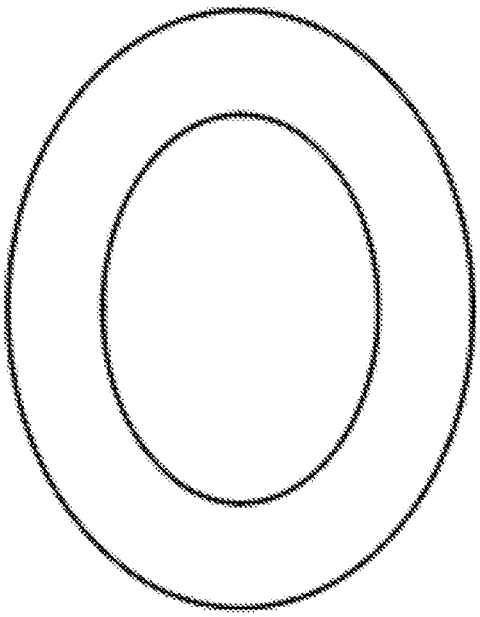
Figure 8:
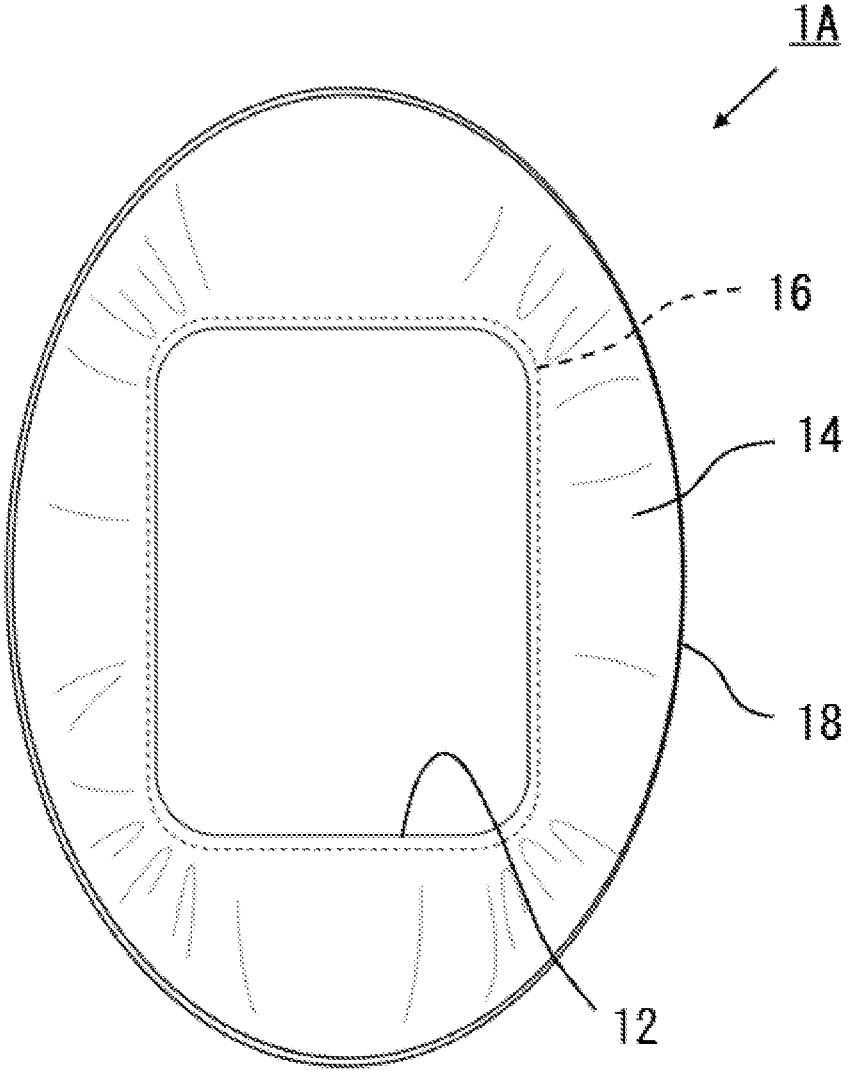
FIG. 8 is a plan view of a headphone cover according to a modification.

While, in the above embodiment, the opening 12 and core 16 have been described as being oval in a plan view, they may have other shapes. The core 16 may have any shape in accordance with the shape of the ear pad 22. For example, instead of an oval shape shown in FIG. 7(*a*), it may have a rectangular shape shown in FIG. 7(*b*), or a wide oval shape shown in FIG. 7(*c*). Also, the core 16 may have any sectional shape, such as a circular or rectangular shape. FIG. 8 shows an example of a plan view of a headphone cover 1A including a core 16 having a rectangular shape.

Figure 9:
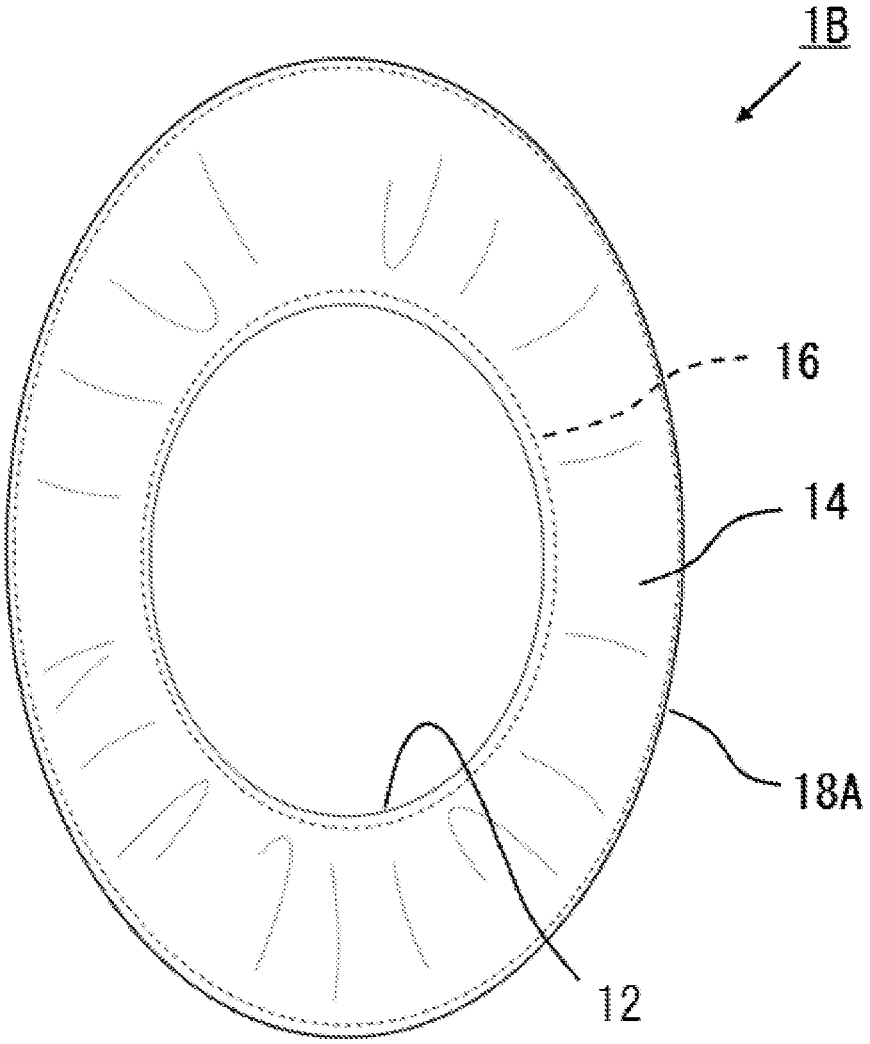
FIG. 9 is a plan view of a headphone cover according to another modification.
Figure 10:
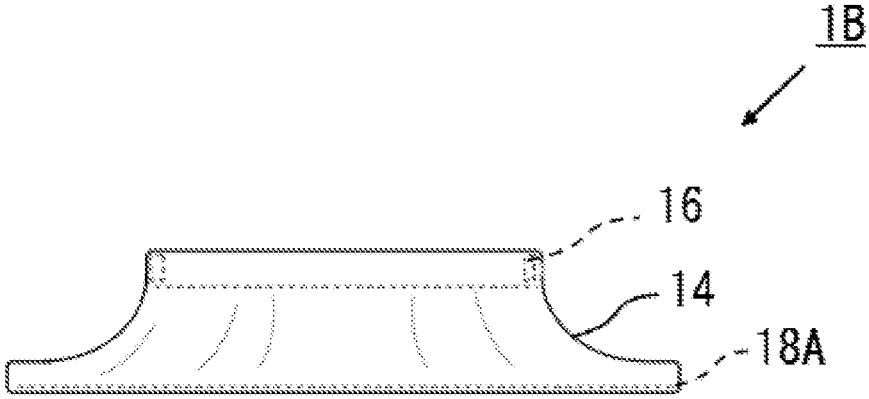
FIG. 10 is a side view of the headphone cover according to the other modification.
Figure 11:
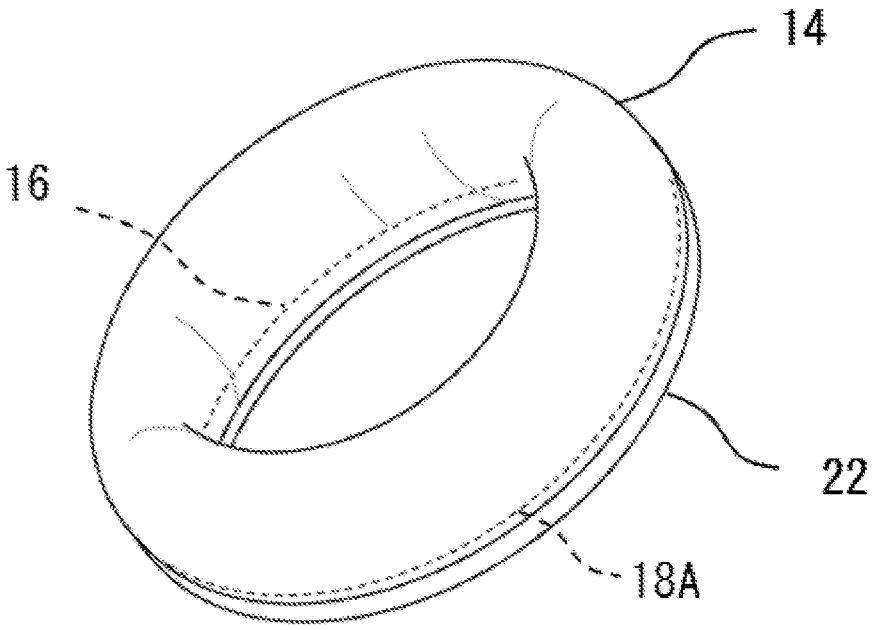
FIG. 11 is a perspective view showing a state in which the headphone cover according to the other modification is mounted on the ear pad of a headphone.

The flat rubber 18 of the headphone cover 1 may be replaced with normal rubber 18A. In this case, the periphery on the other side of the fabric 14 is folded so as to cover the rubber 18A, and then is sewn into a tubular shape. FIGS. 9 to 11 are drawings showing an example configuration of a headphone cover 1B obtained by replacing the flat rubber 18 of the headphone cover 1 with the rubber 18A, in which. FIG. 9 is a plan view of the headphone cover 1B; FIG. 10 is a side view; and FIG. 11 is a perspective view showing a state in which the headphone cover 1B is mounted on the ear pad of a headphone.

INDUSTRIAL APPLICABILITY

The headphone cover of the present invention can be used with any type of closed-back headphone. This headphone cover does not block a sound from a headphone, and its fabric is able to stably keep covering the headphone.

REFERENCE SIGNS LIST

1 headphone cover
12 opening
14 fabric
16 core
18 flat rubber
18A rubber
22 ear pad
24 headphone body

What is claimed is:

1. A headphone cover used between an ear pad of a closed-back headphone and an ear, comprising:

fabric that has an opening in a position corresponding to a sound passage position on one side of the ear pad and is foldable from the one side toward another side of the ear pad; and a core disposed around the opening, wherein a compressive yield force in an extending direction of the core is equal to or greater than 0.0587 Mpa.

2. The headphone cover of claim 1, wherein the core is deformed when bending stress in a direction perpendicular to the extending direction is equal to or smaller than 0.057 Mpa.

3. The headphone cover of claim 1, further comprising fixing flat rubber disposed on the other side of the fabric.

4. The headphone cover of claim 2, further comprising fixing flat rubber disposed on the other side of the fabric.

* * * * *